US007036462B2

(12) United States Patent
Cohen

(10) Patent No.: US 7,036,462 B2
(45) Date of Patent: May 2, 2006

(54) BOILER AND BURNER APPARATUS

(75) Inventor: Kenneth W. Cohen, Fort Lee, NJ (US)

(73) Assignee: Mestek, Inc., Westfield, MA (US)

( * ) Notice: Subject to any disclaimer, the term of this patent is extended or adjusted under 35 U.S.C. 154(b) by 0 days.

(21) Appl. No.: 11/070,534

(22) Filed: Mar. 2, 2005

(65) Prior Publication Data

US 2005/0193959 A1 Sep. 8, 2005

Related U.S. Application Data

(60) Provisional application No. 60/549,573, filed on Mar. 2, 2004.

(51) Int. Cl.
*F22B 13/02* (2006.01)

(52) U.S. Cl. ..... 122/30; 122/10

(58) Field of Classification Search ..... 122/10, 122/30, 4 D, 46, 92, 117, 124, 128
See application file for complete search history.

(56) References Cited

U.S. PATENT DOCUMENTS

| | | | | |
|---|---|---|---|---|
| 2,845,905 | A * | 8/1958 | Smith | 122/30 |
| 4,344,479 | A * | 8/1982 | Bailey | 165/109.1 |
| 4,646,637 | A * | 3/1987 | Cloots | 110/245 |
| 5,890,458 | A * | 4/1999 | Kim | 122/367.3 |
| 6,684,823 | B1 * | 2/2004 | Plavnik et al. | 122/379 |

* cited by examiner

*Primary Examiner*—Gregory Wilson
(74) *Attorney, Agent, or Firm*—McCormick, Paulding & Huber LLP

(57) ABSTRACT

A boiler apparatus includes a housing defining an interior boiler chamber and a burner element arranged to be in thermal communication with the boiler chamber. An ignition device is provided for instigating combustion of an inlet gas stream, and is arranged adjacent one edge of the burner element. A gas restricting device is utilized for restricting contact between the burner element and the inlet gas stream such that the inlet gas stream is initially incident upon the one edge of the burner element, thereby forcing the inlet gas stream to propagate across the burner element from the one edge.

20 Claims, 2 Drawing Sheets

BOILER AND BURNER APPARATUS

CROSS REFERENCE TO RELATED APPLICATIONS

This application claims the benefit of U.S. Provisional Application Ser. No. 60/549,573, filed on Mar. 2, 2004, herein incorporated by reference in its entirety.

FIELD OF THE INVENTION

This invention relates in general to a boiler and burner apparatus, and deals more particularly with a down-fired boiler and burner apparatus that reduces the sensibility to boiling as well as increasing the efficiency of the burner assembly.

BACKGROUND OF THE INVENTION

In known cast iron boilers, typically utilized in residential or commercial settings to provide heated water for heating purposes or the like, the inhibition of a boiling action in the boiler fluid is paramount. As will be appreciated, boiling of the boiler fluid causes a substantial, and frequently rapid, expansion of the boiler fluid volume, which may precipitate possible catastrophic damage to the system as a whole. Thus, differing boiler configurations have been employed to prevent the occurrence of actual boiling in the boiler system.

One commonly employed method utilized to prevent boiling in boiler systems is the introduction of increased pressure within the boiler chamber and related piping. By increasing the pressure within the system, it is possible to heat the boiler fluid to a temperature above what its normal boiling point would be at ambient atmospheric pressure. Increased boiler chamber pressure thus enables the production of superheated boiler fluid, which may then be effectively utilized throughout the heating system while avoiding any damaging volumetric expansion of the boiler fluid.

Another known method of limiting the conditions conducive to boiling involves causing the boiler fluid to circulate, or flow, in a manner that will effectively disperse the heat in the boiler equally to all portions of the boiler fluid. The management of boiler fluid flow paths and velocity are integral to both below-fired boilers and down-fired boilers.

In below-fired boilers, the burner assembly is typically located adjacent the bottom of the boiler, thereby causing rapid mixing and circulation of the boiler fluid due to buoyant convection in the total liquid volume. Fluctuations in the return water temperature, BTU input or saturation temperature are thereby absorbed in the total heat capacity of the boiler.

In down-fired boiler configurations, the burner assembly is instead located adjacent the upper portion of the boiler, effectively having no volume of water above the area where heat is being generated. Consequently, the heat being added to the system is dispersed and circulated via convection. In an effort to increase the circulation and efficiency of down-fired boilers, a series of inner baffles are known to be utilized within the boiler chamber to create a measure of fluid velocity across the inner surface of the boiler chamber.

The use of baffles, while increasing somewhat the velocity and circulation of the boiler fluid, presents its own set of concerns. The sheer number and configuration of the inner baffles increase the difficulty, and related costs, of the casting process when manufacturing typical cast iron boilers. Moreover, the inner baffles themselves may create pockets of non-circulating, or low-circulating, fluid. This is true particularly in the areas adjacent where the baffles contact the side walls of the boiler chamber. As known to those of skill in the art, localized areas of low or non-circulating boiler fluid creates an environment that may promote undesirable boiling. There thus exists a need to design a down-fired boiler that not only promotes boiler fluid circulation, but also reduces the incidence of low-circulating pockets of fluid.

Another concern for down-fired boilers is the operation of the burner assembly itself. In such systems, the fuel mixture is typically dispersed across the entire surface of the burner element at essentially the same time. Since the initial ignition of the fuel mixture occurs at one location adjacent the burner element, the fuel mixture located away from the ignition site typically propagates some distance away from the burner element prior to igniting.

As will be appreciated, the ignition of pockets of fuel located some distance away from the burner element causes a rough and oftentimes noisy ignition that, over time, may cause damage to the burner element as well as being audibly disconcerting.

With the forgoing problems and concerns in mind, it is the general object of the present invention to provide a down-fired boiler and burner apparatus that reduces the sensibility to boiling as well as increases the efficiency of the burner assembly.

SUMMARY OF THE INVENTION

It is an object of the present invention to provide a down-fired boiler and burner apparatus.

It is another object of the present invention to provide a down-fired boiler and burner apparatus that reduces the sensibility to boiling as well as increasing the efficiency of the burner assembly.

It is another object of the present invention to provide a down-fired boiler that reduces the possibility of boiling in the boiler fluid.

It is another object of the present invention to provide a down-fired boiler and burner apparatus that increases the circulation and velocity of boiler fluid.

It is another object of the present invention to provide a down-fired boiler and burner apparatus that produces a substantially silent ignition of the fuel mixture.

In accordance with a preferred embodiment of the present invention, a boiler apparatus includes a housing defining an interior boiler chamber and a burner element arranged to be in thermal communication with the boiler chamber. An ignition device is provided for instigating combustion of an inlet gas stream, and is arranged adjacent one edge of the burner element. A gas restricting device is utilized for restricting contact between the burner element and the inlet gas stream such that the inlet gas stream is initially incident upon the one edge of the burner element, thereby forcing the inlet gas stream to propagate across the burner element from the one edge. A turning vane is also provided and is disposed adjacent an inlet aperture for the boiler fluid. The turning vane diverts the boiler fluid such that the boiler fluid is caused to initially flow adjacent an interior surface of the boiler chamber.

These and other objectives of the present invention, and their preferred embodiments, shall become clear by consideration of the specification, claims and drawings taken as a whole.

DETAILED DESCRIPTION OF THE PREFERRED EMBODIMENT

Figure 1:
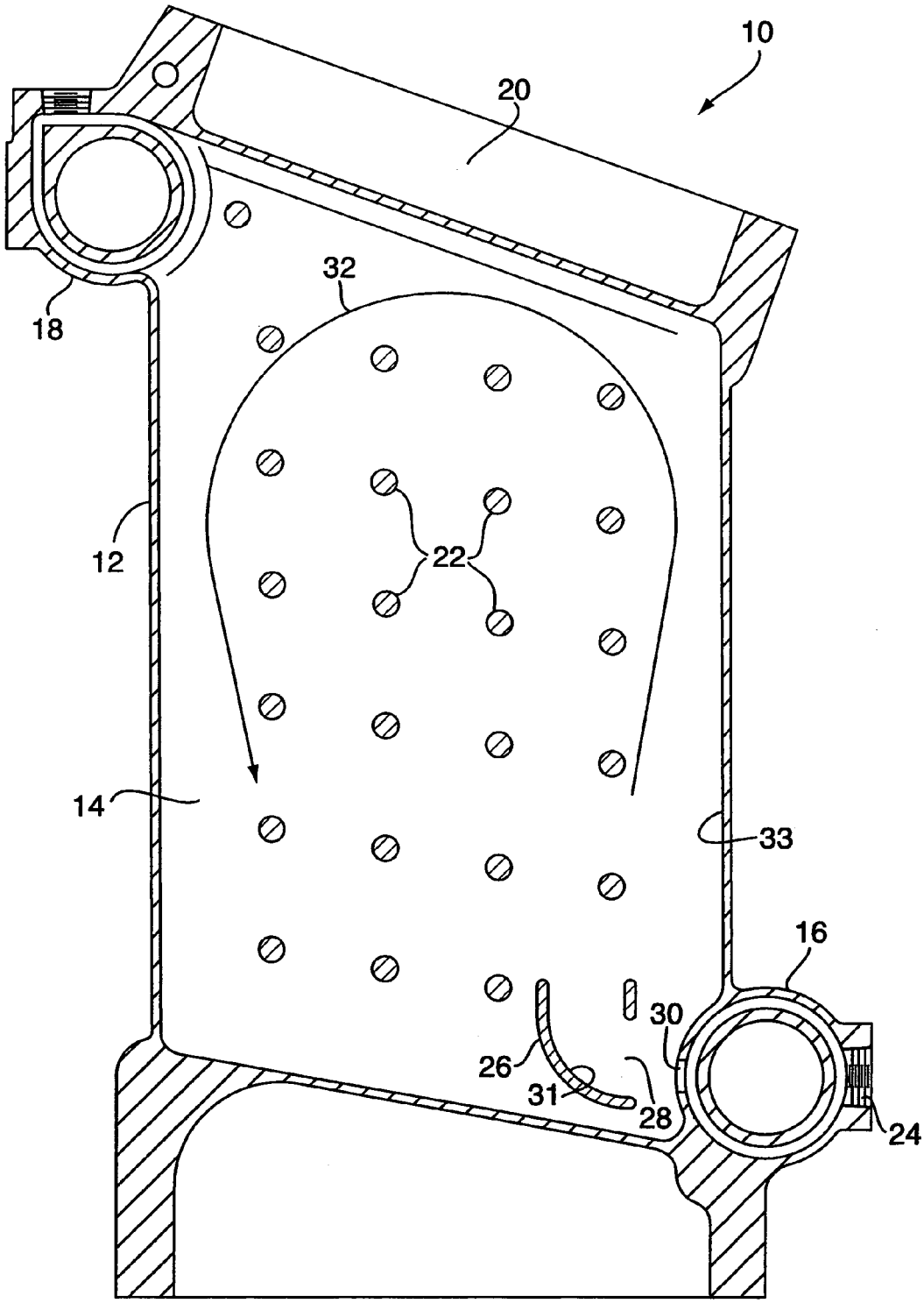
FIG. 1 is a cross-sectional view of a down-fired boiler, according to one embodiment of the present invention.

FIG. 1 illustrates a cross-sectional view of a down-fired boiler 10, in accordance with one embodiment of the present invention. As shown in FIG. 1, the boiler 10 includes a boiling housing 12 defining an inner boiler chamber 14. A boiler fluid inlet manifold 16 and a boiler fluid outlet manifold 18 are also shown in FIG. 1. A presently non-illustrated burner assembly is disposed adjacent the upper portion 20 of the boiler 10, and will be described in more detail later.

It will be readily appreciated that the boiler fluid most commonly utilized is water, although the present invention is not limited in this regard as alternative fluids may be utilized without departing from the broader aspects of the present invention.

Returning to FIG. 1, the inner volume of the boiler chamber 14 includes a plurality of structural stays 22 that are spaced throughout the inner volume of the boiler chamber 14. The stays 22 provide structural support to the boiler 10 when the boiler chamber 14 is subjected to an increased pressure regimen, as is typically known in the art. Although the stays 22 are shown in a substantially uniform pattern, the location, spacing, size and number of the stays 22 defined in the boiler chamber 14 may be readily altered to accommodate a particular design or performance characteristic without departing from the broader aspects of the present invention.

In a preferred embodiment of the present invention, the boiler fluid inlet manifold 16 extends substantially the entire width of the boiler 10 and receives an inlet water supply via one or more conduits 24. Running substantially parallel to the boiler fluid inlet manifold 16 is a turning vane 26 that is defined within the boiler chamber 14. The turning vane 26 is also preferably fashioned to extend substantially the entire inner width of the boiler chamber 14 and defines an inlet opening 28 into which the inlet water supply may be incident via one or more manifold apertures 30 formed in the boiler fluid inlet manifold 16.

In a preferred embodiment, the boiler fluid inlet manifold 16 would define a plurality of distinct manifold apertures 30 for directing the inlet water into the boiler chamber 14. Moreover, the inlet opening 28 of the turning vane 26 would be preferably defined as a continuous, elongated slot that extends substantially the entire inner width of the boiler chamber 14. In this manner, the inlet opening 28 would readily accept the inlet water as directed by manifold apertures 30. The present invention, however, is not limited in this regard. Alternative configurations, such as forming the manifold apertures 30 as a single, continuous and elongated slot, or by defining a plurality of distinct inlet openings 28 in the turning vane 26, are equally contemplated by the present invention.

It is therefore an important aspect of the present invention that the boiler fluid inlet manifold 16 is capable of directing the inlet water flow to the turning vane 26 such that an increased fluid flow and circulation is enabled within the boiler chamber 14. That is, the structural configuration of the turning vane 26 promotes the channeling of the inlet water along the inner surfaces of the boiler housing 12, in a direction substantially perpendicular to the direction of the inlet water flow coming out of the manifold aperture 30. The channeled water will have a higher velocity than the ambient fluid within the boiler chamber 14 and thus, the channeled water will entrain the surrounding fluid and create a recirculation flow of fluid in the boiler chamber 14.

As will further be appreciated, the channeled water will more readily attach itself to the inner walls of the boiler housing 12, thus making the entrainment of the surrounding fluid more difficult adjacent the inner walls. In this manner, the surrounding fluid will more readily entrain from the open, inner side of the channeled water and produce a high velocity flow 32 within the boiler chamber 14.

It is therefore another important aspect of the present invention that the turning vane 26 creates a pump-like action within the boiler chamber 14 such that the high velocity flow 32, having substantial volume, is produced within the boiler chamber 14. The high velocity flow 32 will more easily absorb heat added by the burner assembly, as well as homogenizing variations in temperature and fluid flow within the boiler chamber 14. The combined effects of the pump-like action of the high velocity flow 32 is to enable the boiler 10 to be operated at higher temperatures for a given pressure than has been heretofore known with existing designs.

The advantageous effects of the turning vane 26 are due in large part to its structural configuration and physical location within the boiler chamber 14. As shown in FIG. 1, the inlet opening(s) 28 of the turning vane 26 is oriented adjacent the manifold aperture(s) 30, such that the velocity of the inlet boiler fluid carries the boiler fluid into the turning vane 26. Moreover, the turning vane 26 defines a radial turn 31 that effectively redirects the inlet boiler fluid up into the boiler chamber 14, and adjacent the inner wall 33 of the boiler chamber 14.

Still yet another important aspect of the present invention is that the configuration of the boiler 10 eliminates the need to cast, or otherwise form, interior baffles within the boiler chamber 14. The elimination of such structures not only significantly reduces the complexity and cost of manufacturing the boilers themselves, but also eliminates those areas of low or non-circulating boiler fluid, thus effectively eliminating the possibility of boiling owing to such concerns.

Figure 2:
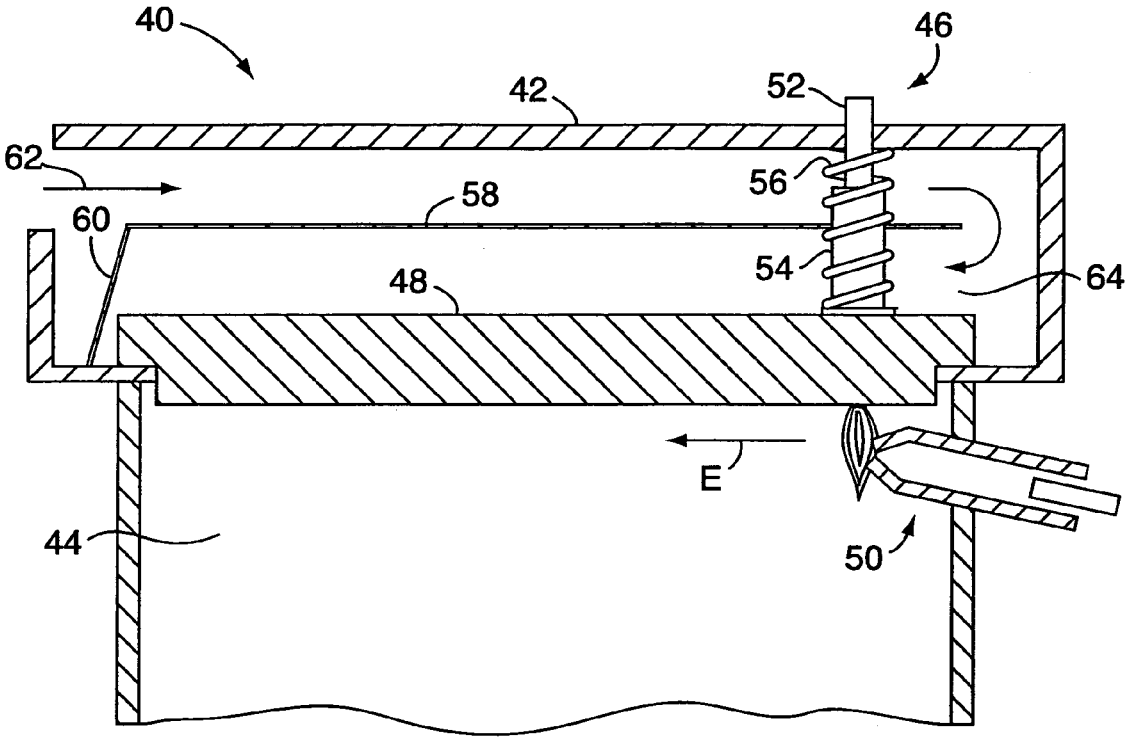
FIG. 2 is a partial cross-sectional view of a burner assembly for a down-fired boiler, in accordance with one embodiment of the present invention.

A burner assembly 40 will now be described for use with down-fired boiler systems. FIG. 2 is a partial cross-sectional view of the burner assembly 40, in accordance with one embodiment of the present invention. As shown in FIG. 2, the burner assembly 40 includes a burner enclosure 42 and a combustion chamber 44. Taken together, the burner enclosure 42 and the combustion chamber 44 substantially enclose a pilot gas assembly 46, a burner element 48 and a spark igniter and flame detection assembly 50.

The pilot gas assembly 46 is utilized to present the pilot gas to the burner element 48 and the spark igniter and flame detection assembly 50. As shown in FIG. 2, a pilot gas orifice 52 directs inlet pilot gas through a pilot mixing tube 54 and to the upper surface of the burner element 48. The pilot gas emerges from the underside of the burner element 48 and is then ignited by the spark igniter and flame detection assembly 50, either manually or through an automated system, as is known in the art. A pilot spring 56 is utilized to assuredly hold the pilot mixing tube in contact with the burner element 48.

In contrast to known systems, the burner assembly 40 includes a flow director 58 which is preferably arranged substantially across the entire width of the burner element 48. As further illustrated in FIG. 2, the flow director 58 has a downwardly extending closed end 60 which effectively isolates the burner element 48 from initial contact with the incoming fuel stream 62. On the opposing lateral side from the closed end 60, the flow director 48 has an open end 64 which also extends substantially the entire width of the burner element 48.

The fuel stream 62 is thus deflected and directed across the upper side of the flow director 58, becoming incident upon the burner element 48 only along the exposed lateral side of the burner element 48 adjacent the open end of the flow director 58. As can be seen in FIG. 2, the open end 64 is arranged to be adjacent the location of the pilot gas assembly 46 and the spark igniter and flame detection assembly 50.

In this manner, the burner assembly 40 of the present invention assures that the fuel stream 62 will first emerge from the underside of the burner element 48 adjacent the location of the spark igniter and flame detection assembly 50. Continued supply of the fuel stream 62 will cause a corresponding and temporally sequential emergence of the fuel stream 62 in a direction across the burner element 48. As will be appreciated, ignition of the fuel stream via actuation of the spark igniter and flame detection assembly 50 will therefore first occur adjacent the spark igniter and flame detection assembly 50, and thereafter propagate in the same direction as the sequential emergence of the fuel stream 62 from the underside of the burner element 48, as indicated by flame propagation arrow F.

It is therefore another important aspect of the present invention that the flow director 58 effectively acts as a gas restricting means for controlling access of the fuel stream 62 to the burner element 48 such that the fuel stream 62 is forced to first contact a predetermined lateral side or edge of the burner element 48 prior to propagating across the burner element 48. In doing so, the flow director 58 ensures that the fuel stream cannot first penetrate the burner element 48 at a location away from the spark igniter and flame detection assembly 50, thus eliminating subsequent migration of the fuel stream 62 away from the surface of the burner element 48 and the noise inherently caused by the ignition of pockets of migrated fuel.

The burner assembly 40 of the present invention thus enables a substantially silent ignition of the fuel stream 62 by essentially coupling the emergence of the fuel stream 62 with the ignition thereof by the spark igniter and flame detection assembly 50.

Still yet another important aspect of the present invention is that the burner assembly 40 not only enables a substantially silent ignition of the fuel stream 62, but it also substantially eliminates any concussive damage caused by the ignition of pockets of fuel that would otherwise have migrated away from the burner element 48 if not for the flow director 58.

In the preferred embodiment, the burner element 48 is formed of a ceramic material and the flow director 58 is formed from a metallic material, although the present invention is not limited in this regard. That is, the present invention equally contemplates that the burner element 48 and the flow director 58 may be formed from any suitable materials without departing from the broader aspects of the present invention.

Figure 3:
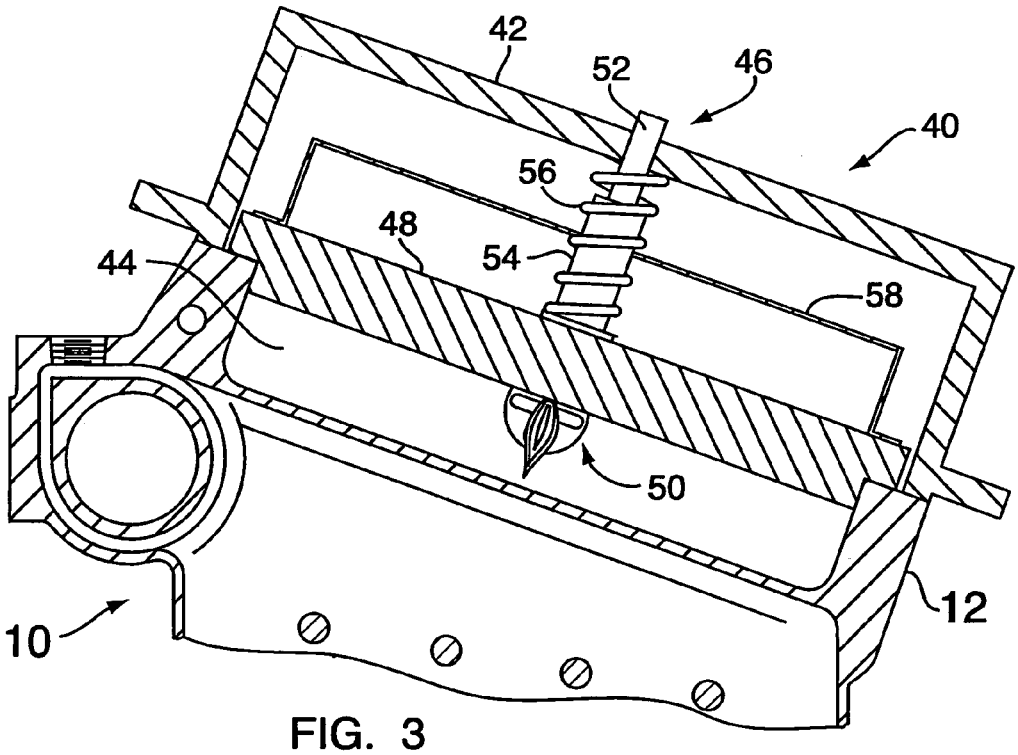
FIG. 3 is a partial cross-sectional view of the burner assembly shown in FIG. 2 as it is mounted adjacent the upper portion of a down-fired boiler.

FIG. 3 illustrates a partial cross-sectional view of the burner assembly 40 shown in FIG. 2 as it is typically mounted, at an angle, adjacent the upper portion 20 of the down-fired boiler 10, shown in FIG. 1.

As will be appreciated by a review of FIGS. 1–3 and the associated discussion above, the present invention provides an improved down-fired boiler and burner apparatus that reduces the sensibility to boiling as well as increases the silent actuation of the burner assembly. Moreover, although the present invention has been described in connection with a down-fired boiler system, the present invention is not limited in this regard or application, as the turning vane and burner assembly of the present invention may be alternatively incorporated in burner systems of differing configurations without departing from the broader aspects of the present invention.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all equivalent embodiments.

What is claimed is:

1. A boiler apparatus comprising:

a housing having an interior boiler chamber;

an inlet manifold having an inlet aperture means formed therein, said inlet aperture means permitting flow of a boiler fluid in a first direction from said inlet manifold to said boiler chamber;

a turning vane disposed adjacent said inlet aperture means, said turning vane diverting said boiler fluid in a second direction;

a burner element arranged to be in thermal communication with said boiler chamber;

a burner enclosure for presenting an inlet gas stream to said burner element via a gas inlet aperture; and a gas restricting means for restricting contact between said burner element and said inlet gas stream such that said inlet gas stream is initially incident upon one edge of said burner element, thereby forcing said inlet gas stream to propagate across said burner element from said one edge.

2. The boiler apparatus according to claim 1, wherein:

said turning vane diverts said boiler fluid such that said boiler fluid is caused to initially flow adjacent an interior surface of said boiler chamber.

3. The boiler apparatus according to claim 1, further comprising:

an ignition device for instigating combustion of said inlet gas stream, said ignition device arranged adjacent said one edge of said burner element; and wherein said gas restricting means comprises a gas flow director arranged about said burner element and having a closed end and an open end, said closed end being oriented adjacent said gas inlet aperture and said open end being oriented adjacent said ignition device.

4. The boiler apparatus according to claim 1, wherein:

said burner element is a down-fired burner element arranged adjacent an upper portion of said burner chamber.

5. The boiler apparatus according to claim 1, wherein:

said inlet aperture means comprises one of a plurality of discreet inlet holes, and an elongated inlet slot.

6. A boiler apparatus comprising:

a housing defining an interior boiler chamber;

an inlet manifold having an inlet aperture formed therein, said inlet aperture facilitating entry of a boiler fluid from said inlet manifold to said boiler chamber;

a turning vane disposed adjacent said inlet aperture, said turning vane diverting said boiler fluid;

a burner element arranged to be in thermal communication with said boiler chamber;

an ignition device for instigating combustion of an inlet gas stream, said ignition device arranged adjacent one edge of said burner element; and a gas restricting means for restricting contact between said burner element and said inlet gas stream such that said inlet gas stream is initially incident upon said one edge of said burner element, thereby forcing said inlet gas stream to propagate across said burner element from said one edge.

7. The boiler apparatus according to claim 6, wherein:

said gas restricting means comprises a gas flow director arranged about said burner element to substantially isolate said burner element from said inlet gas stream, said gas flow director having an open end oriented adjacent said ignition device.

8. The boiler apparatus according to claim 6, wherein:

said burner element is a down-fired burner element arranged adjacent an upper portion of said burner chamber.

9. A method of operating a boiler having a boiler chamber and an inlet flow of boiler fluid into said boiler chamber, said method comprising the steps of:

directing said inlet flow of boiler fluid such that said boiler fluid flows adjacent an interior surface of said boiler; and arranging a structural support post in said boiler chamber, said support post extending between opposing walls of said boiler chamber.

10. The method of operating a boiler according to claim 9, said method further comprising the steps of:

arranging a turning vane adjacent said inlet flow of boiler fluid, said turning vane defining a radial turn for directing said inlet flow of said boiler fluid adjacent said interior surface.

11. The method of operating a boiler according to claim 9, said method further comprising the steps of:

arranging a burner element to be in thermal communication with said boiler chamber;

arranging an ignition device adjacent one edge of said burner element for instigating combustion of an inlet gas stream; and restricting contact between said burner element and said inlet gas stream via a gas restricting means such that said inlet gas stream is initially incident upon said one edge of said burner element, thereby forcing said inlet gas stream to propagate across said burner element from said one edge.

12. The method of operating a boiler according to claim 11, wherein:

said gas restricting means comprises a gas flow director arranged about said burner element to substantially isolate said burner element from said inlet gas stream, said gas flow director having an open end oriented adjacent said ignition device.

13. A boiler apparatus comprising:

a housing defining an interior boiler chamber;

a burner element arranged to be in thermal communication with said boiler chamber;

an ignition device for instigating combustion of an inlet gas stream, said ignition device arranged adjacent one edge of said burner element; and a gas restricting means for restricting contact between said burner element and said inlet gas stream such that said inlet gas stream is initially incident upon said one edge of said burner element, thereby forcing said inlet gas stream to propagate across said burner element from said one edge.

14. The boiler apparatus according to claim 13, wherein:

said gas restricting means comprises a gas flow director arranged about said burner element to substantially isolate said burner element from said inlet gas stream, said gas flow director having an open end oriented adjacent said ignition device.

15. The boiler apparatus according to claim 13, wherein:

an inlet manifold having an inlet aperture formed therein, said inlet aperture facilitating entry of a boiler fluid from said inlet manifold to said boiler chamber; and a turning vane disposed adjacent said inlet aperture, said turning vane diverting said boiler fluid such that said boiler fluid is caused to initially flow adjacent an interior surface of said boiler chamber.

16. The boiler apparatus according to claim 13, wherein:

said burner element is a down-fired burner element arranged adjacent an upper portion of said burner chamber.

17. A boiler apparatus comprising:

a housing defining an interior boiler chamber;

a burner element arranged to be in thermal communication with said boiler chamber;

an ignition device for instigating combustion of an inlet gas stream, said ignition device arranged adjacent one edge of said burner element;

a gas restricting means for restricting contact between said burner element and said inlet gas stream such that said inlet gas stream is initially incident upon said one edge of said burner element, thereby forcing said inlet gas stream to propagate across said burner element from said one edge;

an inlet manifold having an inlet aperture formed therein, said inlet aperture facilitating entry of a boiler fluid from said inlet manifold to said boiler chamber; and a turning vane disposed adjacent said inlet aperture, said turning vane diverting said boiler fluid such that said boiler fluid is caused to initially flow adjacent an interior surface of said boiler chamber.

18. The boiler apparatus according to claim 17, wherein:

said gas restricting means comprises a gas flow director arranged about said burner element to substantially isolate said burner element from said inlet gas stream, said gas flow director having an open end oriented adjacent said ignition device.

19. A boiler apparatus comprising:

a housing having an interior boiler chamber;

an inlet manifold having an inlet aperture means formed therein, said inlet aperture means permitting flow of a boiler fluid in a first direction from said inlet manifold to said boiler chamber;

a turning vane disposed adjacent said inlet aperture means, said turning vane diverting said boiler fluid in a second direction; and wherein said inlet aperture means comprises one of a plurality of discreet inlet holes, and an elongated inlet slot.

20. A method of operating a boiler having a boiler chamber and an inlet flow of boiler fluid into said boiler chamber, said method comprising the steps of:

directing said inlet flow of boiler fluid such that said boiler fluid flows adjacent an interior surface of said boiler chamber;

arranging a burner element to be in thermal communication with said boiler chamber;

arranging an ignition device adjacent one edge of said burner element for instigating combustion of an inlet gas stream; and restricting contact between said burner element and said inlet gas stream via a gas restricting means such that said inlet gas stream is initially incident upon said one edge of said burner element, thereby forcing said inlet gas stream to propagate across said burner element from said one edge.

* * * * *